US008985246B2

(12) United States Patent
Lynde

(10) Patent No.: US 8,985,246 B2
(45) Date of Patent: Mar. 24, 2015

(54) SUBTERRANEAN CUTTING TOOL STRUCTURE TAILORED TO INTENDED USE

(75) Inventor: Gerald D. Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 581 days.

(21) Appl. No.: 12/892,631

(22) Filed: Sep. 28, 2010

(65) Prior Publication Data

US 2012/0073880 A1 Mar. 29, 2012

(51) Int. Cl.
*E21B 10/43* (2006.01)
*E21B 29/00* (2006.01)

(52) U.S. Cl.
CPC ..... *E21B 10/43* (2013.01); *E21B 29/00* (2013.01)
USPC ..... 175/430; 175/327

(58) Field of Classification Search
USPC ..... 175/430, 327
See application file for complete search history.

(56) References Cited

U.S. PATENT DOCUMENTS

| | | | | |
|---|---|---|---|---|
| 4,529,338 | A | 7/1985 | Erkfritz | |
| 4,796,709 | A | 1/1989 | Lynde et al. | |
| 5,038,859 | A | 8/1991 | Lynde et al. | |
| 5,086,838 | A | 2/1992 | Cassel et al. | |
| 5,456,312 | A | 10/1995 | Lynde et al. | |
| 5,860,773 | A | 1/1999 | Blomberg et al. | |
| 5,944,462 | A * | 8/1999 | Woodward | 409/74 |
| 6,883,624 | B2 * | 4/2005 | McDonough | 175/428 |
| 7,363,992 | B2 * | 4/2008 | Stowe et al. | 175/426 |
| 2002/0121393 | A1 | 9/2002 | Thigpen et al. | |
| 2007/0079995 | A1 * | 4/2007 | McClain et al. | 175/426 |
| 2010/0000741 | A1 | 1/2010 | Jameson | |
| 2010/0089649 | A1 | 4/2010 | Welch et al. | |
| 2011/0031035 | A1 * | 2/2011 | Stowe et al. | 175/430 |

FOREIGN PATENT DOCUMENTS

EP 0916803 A2 5/1999

OTHER PUBLICATIONS

Carbide Depot.com; Technical Resources for Manufacturing Professionals, Choosing Insert Shape, 1 page, date unknown.
Fansteel VR/Wesson, Tool Geometry, 312-313, date unknown.

* cited by examiner

*Primary Examiner* — Catherine Loikith
(74) *Attorney, Agent, or Firm* — Steve Rosenblatt

(57) ABSTRACT

A mill cutting structure is differently configured in three zones. Those zones are the center, the outer edge and in between. At the center has highly wear resistant material that has good temperature bond strength and high impact resistance. The outer periphery can have a material that is highly resistant to wear and impact. In between can be inserts such as used in the Metal Muncher® mills using sintered carbide shapes that resist tracking and create a chipping rather than a grinding action. The shapes should have high edge retention capability and shapes such as a double sided pyramid can be used. The wear patterns of prior designs are addressed to allow longer and faster milling of the fish.

18 Claims, 4 Drawing Sheets

SUBTERRANEAN CUTTING TOOL STRUCTURE TAILORED TO INTENDED USE

FIELD OF THE INVENTION

The field of the invention is subterranean milling tools and more particularly those mills that employ discrete cutting structures at different locations on the mill body to address the expected type of wear unique to that location so that overall milling effectiveness is improved.

BACKGROUND OF THE INVENTION

There are occasions where downhole devices such as packers or bridge plugs or cement shoes are milled out. Other times there is a tubing string or portion of a tubing string that needs to be cut so that subsequent operations can continue. Over time the design of such mills has evolved to address the need for greater speed and cutting efficiency. In the 1980s Baker Hughes came out with a line of mills known as Metal Muncher® as illustrated in U.S. Pat. Nos. 5,038,859 or 5,086,838; 4,796,709 and 5,456,312.

One example of this design is shown in FIGS. 1 and 2. The typical mill of this type had a body 10 with a central flow passage 12 that lead to a plurality of outlets 14 shown on the bottom face view of FIG. 2. A series of spaced apart vertical blades 16 had their leading face covered with a nested array of round inserts 18 made of a hardened cutting material such as tungsten carbide. These inserts were arranged in rows such as 20 and 22 and as one row would wear away with the blade that supported it the next row would take over the cutting task. Fluid such as drilling mud would be pumped through the outlets 14 located ahead of the inserts 18 on a given blade 16 in the direction of rotation. A matrix material 24 is deployed behind the blades 16 for structural support and for some limited cutting capability. The cuttings made by the inserts have to clear the outside edge of the mill and are carried off by the circulating fluid that also removes some of the heat generated from the milling operation.

Another prior mill design in three styles is illustrated in FIGS. 3-5. Here there are no blades and the matrix material with the crushed carbide particles in seen in a symmetrical array of pie shapes 26 about a center where there is no matrix or carbide particles. Each of the pie shapes has the identical formulation as the others. In some applications there are fluid outlets 28 or 30 illustrated to carry off cuttings and heat generated from the milling operation.

The common theme to these prior designs is symmetry about a center of the mill and uniformity of the cutting structure regardless of the position on the mill. While there was some intuitive rationale behind symmetry, the demands on different locations of a mill are not symmetrical and in certain cutting applications the limitations of such prior designs were made apparent.

The center of the mill has very low relative speed to the surface being cut and is a region where there is high abrasion and heat generation. In the previous designs this region tended to core badly as the matrix softened from heat and abrasion and then sloughed off to create the coring effect. As the core formed the cutting around the middle of the mill body deteriorated and as a result of that the ability of the mill to advance into the fish being milled was also impeded. The fish itself developed a peak which was the negative of the shape of the core that formed in the center bottom of the mill where the matrix was abraded off. It should be noted that in some milling applications such as when a packer with a hollow mandrel is milled there is little wear in the center of the mill as the packer mandrel is hollow. However, as the packer slips release their grip during milling the orientation of the packer can shift and the coring effect can be seen.

When chunks of the packer break off such as broken pieces of slips and the circulating fluid has to carry the cuttings to the edge of the body and then up the sides through recesses or water courses so that the cuttings can be recovered at the surface what results is high impact loading at the transition between the bottom and side of the mill such that the edge gets rounded off. This removal of the cutting structure from the periphery impedes the cutting ability of the mill. This effect can also require a trip in the hole for mill replacement which, particularly in offshore locations, can be a very expensive proposition.

The present invention focuses on tailoring the cutting structure to the nature of the expected wear on different parts of a mill. Thus the center of the mill uses a more abrasion resistant material to combat coring but the shapes of the cutting structure can be more rounded and less aggressive as most of the serious cutting occurs further away from the mill center. The outer periphery is made more impact resistant with a somewhat more aggressive cutting structure than the center of the mill. This is designed to control the rounding at the edges and associated loss of cutting structure adjacent the outer periphery. In between where the bulk of the cutting takes place the cutting structure is configured to be more robust and more highly resistant to having chunks of carbide to break off. As a result the carbide shapes in the matrix have more blunt cutting edges as opposed to the carbide at the periphery where there are longer extending segments and sharper angles so that there is a greater impact resistance with a decreased emphasis on cutting ability. These and other aspects of the present invention will be more apparent to those skilled in the art from a review of the description of the preferred embodiment and the associated figures while recognizing that the full scope of the invention is to be found in the appended claims.

SUMMARY OF THE INVENTION

A mill cutting structure is differently configured in three zones. Those zones are the center, the outer edge and in between. At the center has highly wear resistant material that has good temperature bond strength and high impact resistance. The outer periphery can have a material that is highly resistant to wear and impact. In between can be inserts such as used in the Metal Muncher® mills using sintered carbide shapes that resist tracking and create a chipping rather than a grinding action. The shapes should have high edge retention capability and shapes such as a double sided pyramid can be used. The wear patterns of prior designs are addressed to allow longer and faster milling of the fish.

DETAILED DESCRIPTION OF THE PREFERRED EMBODIMENT

Figure 2:
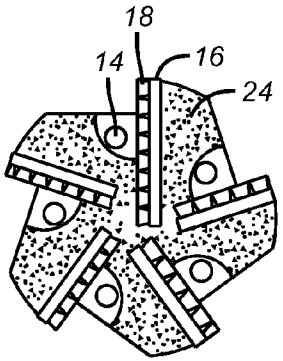
(PRIOR ART) FIG. 2
FIG. 2 is a bottom view of FIG. 1.
Figure 1:
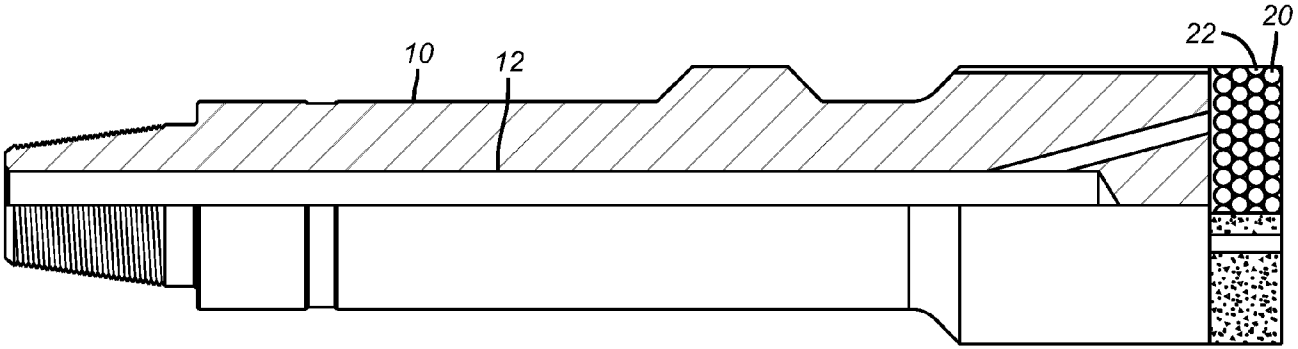
(PRIOR ART) FIG. 1
FIG. 1 is a side view of a Metal Muncher® prior art mill.
Figure 5:
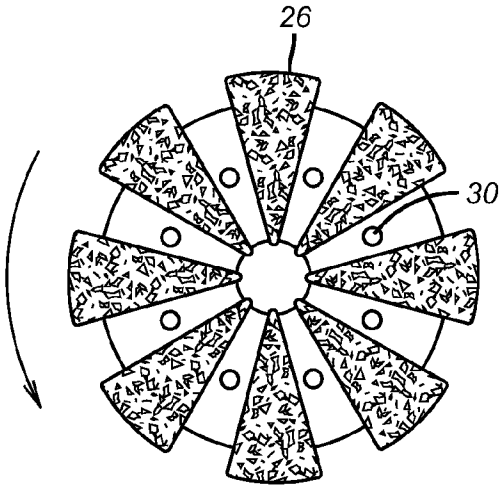
(PRIOR ART) FIG. 5
FIG. 5 is a bottom view of a prior art junk mill.
Figure 4:
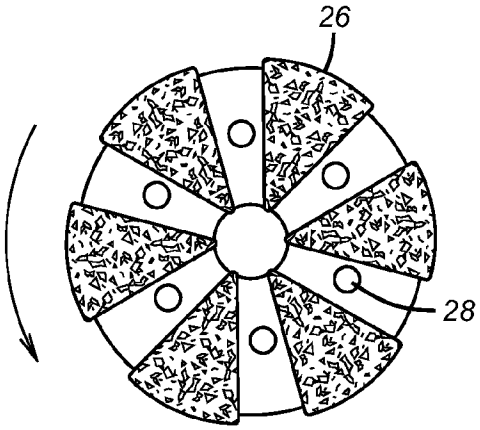
(PRIOR ART) FIG. 4
FIG. 4 is a bottom view of a prior art junk mill.
Figure 3:
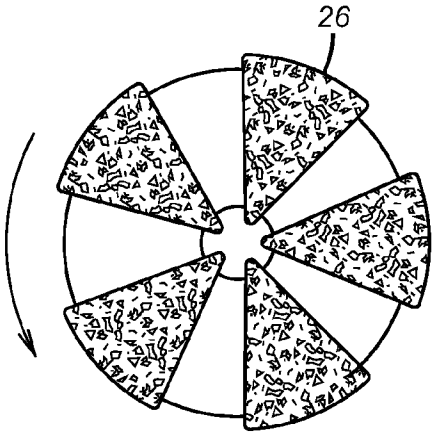
(PRIOR ART) FIG. 3
FIG. 3 is a bottom view of a prior art junk mill.
Figure 6:
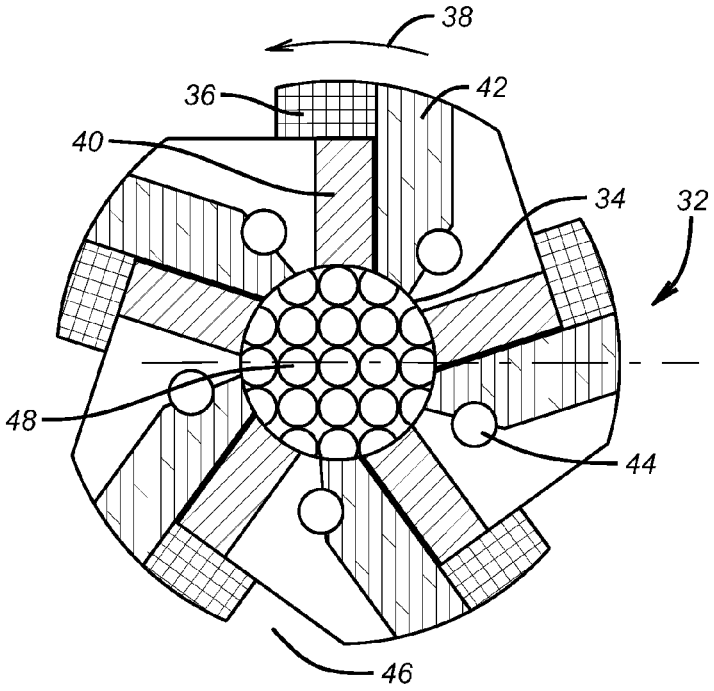
FIG. 6 is a bottom view of a mill of the present invention showing the locations of the different cutting structures.
Figure 7:
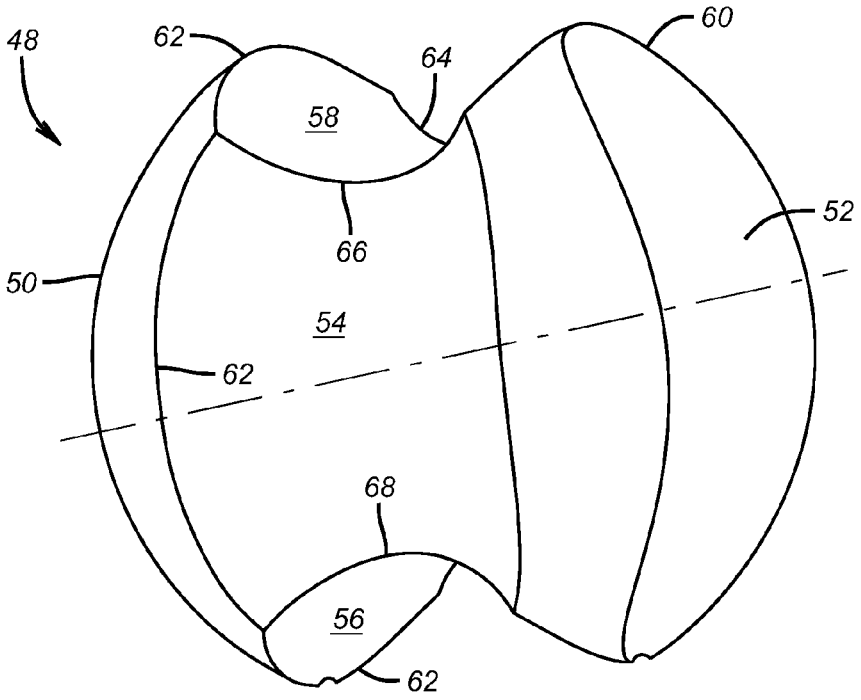
FIG. 7 is a detailed view of an insert shape that is best used at the mill center or the mill periphery.

FIG. 6 shows the bottom view of a mill 32 that has a central zone 34 and a plurality of leading peripheral spaced apart zones 36 as determined by the direction of rotation represented by the arrow 38. In between are leading 40 and trailing 42 cutting regions where most of the cutting takes place and the chips off the fish are formed. The trailing region is also disposed behind the peripheral zones 36 in the direction of rotation. A series of ports 44 border the trailing region 42 and are there to allow pumped fluid to drive the cuttings to the edges where they can make a turn uphole through gaps such as 46. The cutting elements 48 in zone 34 are illustrated in detail in FIG. 7. This shape is formed from a starting shape of a sphere and cut with a cylindrical drill that passes through the shape at four perpendicular orientations. This leaves end rounded shapes 50 and 52 that are spherical and are separated by four part cylindrical walls of which three are visible in FIG. 7 namely 54, 56 and 58. The idea, regardless of the fabrication technique is to create some cutting edges in an otherwise fairly rounded shape so that the impact resistance is high while the penetration into the fish from such shapes dispersed in a matrix in zone 34 is fairly low. The main objective in zone 34 being to withstand the impact loads and heat generated and to remain in position long enough to prevent coring the center zone 34 by having parts of the carbide shapes break off. In past designs the inserts that were best suited for cutting in zones 40 or 42 were also used in the central zone where the loading was different so that the performance of those inserts such as 18 in FIG. 2 when in the center of the mill did not optimally prevent coring. In the present invention the inserts 48 are fairly rounded but still have some cutting edges such as 60 and 62 in generally parallel planes and other cutting edges such as 64, 66 and 68 that are generally parallel to each other and in planes approximately perpendicular to edges 60 and 62. Insert 48 can also be used in the peripheral zones 36 where the ability to resist high impact is more significant than cutting ability. Thus with a modest amount of cutting edges and a rounded overall shape coupled with placement at the bottom center zone 34 and the peripheral locations 36 the problems associated with the prior designs and their uniform insert distribution are avoided. At the center zone 34 the rounded shape tolerates high impacts such as can occur when milling a string inside another string where the inner string being milled is laying up against the outer string so that the mill center is over a wall portion of the fish trying to mill it out. The center zone 34 can receive impact loads as the mill bounces against the pipe wall of the fish. Heat is also generated there and the material for the matrix as well as the insert is selected to tolerate this expected heat load. The insert material can be tungsten carbide, cubic boron, polycrystline diamond compacts and other hard material cutting elements and the matrix in which it is embedded can be brazing materials like nickel bronze, silver solder, copper bronze and other braze materials having a significant wetting ability and high yield strengths.

Figure 8:
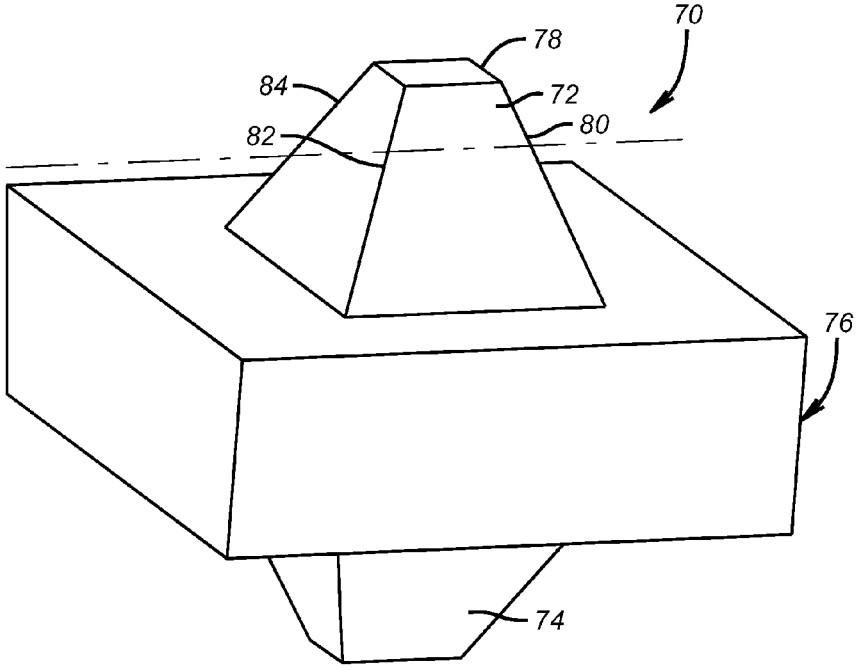
FIG. 8 is a detailed view of an insert best used between the center and the periphery and preferably on the leading cutting surface.

The leading zone for creating the chips off the fish is 40. Here it is desirable to have a robust structure that can hold an edge or generate an edge as the milling progresses. The insert 70 shown in FIG. 8 is preferred for this service. Also suitable are cylindrically shaped inserts and inserts where cutting edges are defined by surfaces that meet at 90 or more degrees. In the illustrated embodiment it features opposed truncated pyramid shapes 72 and 74 on opposed sides of a rectangular block 76. Cutting edges abound in this shape and its limited protrusion distance from the block 76 makes the pyramid shape edges such as 78, 80 82 and 84 more likely to remain in position rather than be chipped off. What characterizes the optimal shape for zone 40 is a massive core structure regardless of shape with protruding and opposed extending shapes that have multiple cutting edges that are generally shorter than the edge dimensions of the core. The extending shapes tend to have a height in the order of magnitude of the smaller core dimension and long and thin shapes are avoided in favor of short bulky shapes with a center of mass closer to the core periphery than the smallest dimension of the core.

Figure 9:
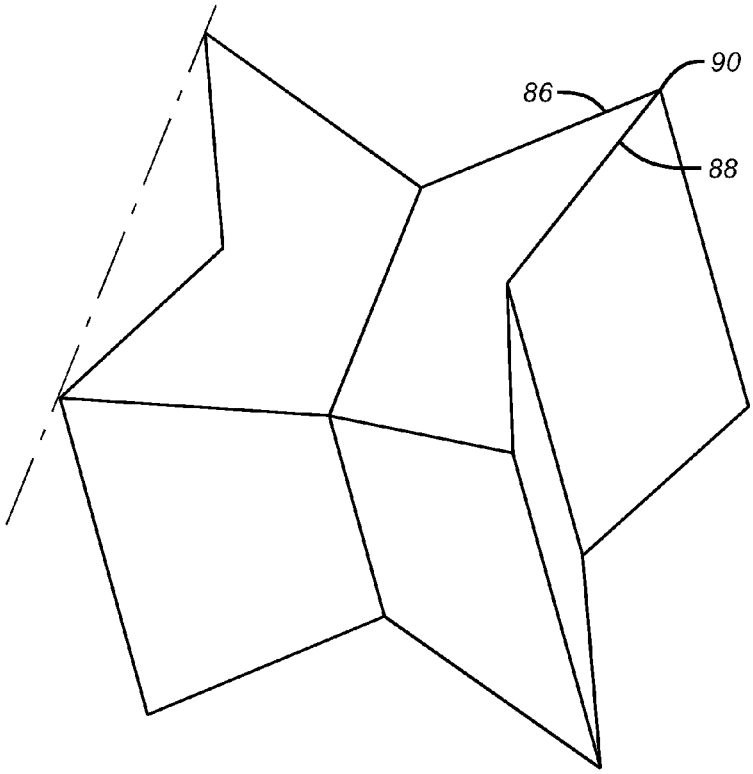
FIG. 9 is a detailed view of an insert shape best used in moderate wear areas between the center and the periphery and in a trailing location to the shape of FIG. 8.

FIG. 9 illustrates a design of lesser strength than in FIG. 8 and one that is best suited for the zone marked 42 in FIG. 6. These designs are characterized by cutting edges where surfaces meet at an angle of under 90 degrees. The bulk of the cutting is taking place in zone 40 where more robust shape with blunter angles such as shown in FIG. 8 is used. The trailing zone 42 does not require the same strength because the cuttings are already for the most part initiated in zone 40. Another advantage of putting a less aggressive shape of FIG. 9 behind the shape of FIG. 8 is when the demand for what is being milled changes. For example, when milling a packer body the need for strength initially is there as the mandrel and body are milled away. When the seal and slips are reached the cutting demand is different. The slips are typically cast iron that breaks more easily. Very aggressive cutting shapes such as in FIG. 8 work far less well in trying to cut a rubber shape. A less aggressive structure minimizes balling of the rubber or composite on the cutting structure. The less aggressive structure is also suitable for milling cast iron slips.

In the present invention the various zones 34, 36, 40 and 42 use the described shapes randomly disposed in a matrix that acts as a binder. Over time different inserts oriented randomly extend from the binder as the binder wears away and as pieces of the inserts wear or get broken off. The present invention seeks to address the different needs of different portions of a mill at a given time by presenting shapes in discrete zones that differ from each other and at the same time meet the cutting and durability needs of the specific zones. Thus the edges 86 and 88 that come to a sharp angled point 90 are more suited to a backup zone such as 42 where strength is less important as criteria for longevity than in primary cutting areas 40. Additionally, if the wear rate of zone 40 is carefully matched to the penetration such as through a packer so that much of zone 40 has worn by the time the slips and the sealing element are being milled then it is more advantageous to have zone 42 evolve into a primary role when the cutting demand for that specific mill location evolves with time.

The contrast to be drawn with the prior mill designs is stark. Instead of selecting a single shape or different sizes of the same shape to deploy on a mill face as an overall compromise decision for the anticipated application, the present invention seeks to tailor specific zones on a mill to their discrete loading issues as the milling progresses. This concept applies to a specific point in time during a milling operation as well as taking into account how the needs of those discrete zones evolve as milling changes from a packer body to packer slips or a sealing element, for example. In that sense, different shapes are disposed to back each other up in the direction of rotation whether the cutting structure is on the bottom of a mill or on a blade. In each zone the shapes are randomly integrated into a binder matrix so that their orientations in the matrix are varied. Yet the less aggressive and more rounded shapes such as in FIG. 7 best serve the expected demands of the center and periphery of the mill where impact loads are high and cutting demand is fairly low. As previously stated there is minimal relative rotation at the center and in most cases little cutting demand such as when there is a central hollow mandrel that remains near the mill center during milling. At the edges, the cuttings need to make the turn into the fluid courses up the side of the bit and high impact loads there are best resisted by a milder cutting structure that can tolerate the impact load while providing some cutting ability. By putting the milder cutting structure at the center the tendency to core the mill at the center is reduced. At the periphery, loss of the edge near the mill bottom due to impact loading is reduced while some limited cutting action can still take place. In the region in between the primary cutting chore is handled by a more blunt cutting shape that has higher strength by virtue of a more compact shape that avoids long and narrow edges and small angle sharp points such as 30-55 degrees. In a backup function behind the primary zone 40 a less aggressive shape with angles in the 30-55 degree range disposed in zone 42 can be useful due to the reduced cutting demand determined by the location. Additionally by being located behind the primary and more aggressive shape of the zone 40, the backup shape of zone 42 can be counted on to take up a more primary load after some milling has worn away zone 40 shapes and the needs for the mill have changed for the zones 40 and 42 as slips or rubber seals need to be milled up as opposed to a steel body that started off the operation.

The above description is illustrative of the preferred embodiment and many modifications may be made by those skilled in the art without departing from the invention whose scope is to be determined from the literal and equivalent scope of the claims below.

I claim:

1. A mill for milling subterranean tools or tubulars, comprising:

a body having a cutting face for tandem rotation with said body having a plurality of radially non-overlapping cutting zones when viewed on any given radial line passing through all said cutting zones and inserts disposed on a lowermost central zone of said body having a circular border to engage the tool or tubular to be milled wherein inserts in said central zone have different shapes than all said inserts in an adjacent radially surrounding intermediate zone;

said cutting face further comprising a peripheral zone adjacent radially to said intermediate zone with blades extending starting from outside said central zone and extending over at least one of said intermediate and peripheral zones.

2. The mill of claim 1, wherein:

said inserts in each zone are randomly distributed in a matrix that binds them together.

3. The mill of claim 2, wherein:

said central zone is circular about an axis of said body.

4. The mill of claim 3, wherein:

said inserts in said central zone comprise rounded impact surfaces defining adjacent curved cutting edges.

5. The mill of claim 2, wherein:

said peripheral zone comprises inserts that have rounded impact surfaces defining adjacent curved cutting edges.

6. The mill of claim 5, wherein:

said peripheral zone comprises spaced locations at the periphery of said body.

7. The mill of claim 5, wherein:

said inserts in said central zone comprise rounded impact surfaces defining adjacent curved cutting edges.

8. The mill of claim 2, wherein:

said intermediate zone has a leading and trailing segment in the direction of rotation;

said leading segment comprises inserts that have larger angles between surfaces that form cutting edges than inserts in said trailing segment.

9. The mill of claim 8, wherein:

said insert angles in said leading segment are at least 90 degrees.

10. The mill of claim 9, wherein:

said insert angles on said trailing edge are less than 90 degrees.

11. The mill of claim 10, wherein:

said central zone is circular about an axis of said body.

12. The mill of claim 11, wherein:

said inserts in said central zone comprise rounded impact surfaces defining adjacent curved cutting edges.

13. The mill of claim 12, wherein:

said peripheral zone comprises inserts that have rounded impact surfaces defining adjacent curved cutting edges.

14. The mill of claim 13, wherein:

said peripheral zone comprises spaced locations at the periphery of said body.

15. The mill of claim 14, wherein:

said leading segment inserts wear by design during milling of a first material and expose more of said inserts in said trailing segments that are better suited to cut a second type of material.

16. The mill of claim 15, wherein:

said first material to be milled comprises a metal and said second material to be milled comprises rubber or a composite.

17. The mill of claim 14, wherein:

said blades are oriented perpendicularly to an axis of said body.

18. The mill of claim 8, wherein:

said leading segment inserts are cylindrically shaped.

* * * * *